United States Patent [19]

Dalebout et al.

[11] Patent Number: 4,918,266

[45] Date of Patent: Apr. 17, 1990

[54] EXERCISE MACHINE SAFETY SWITCH

[75] Inventors: William T. Dalebout; Ty Measom, both of Logan, Utah

[73] Assignee: Weslo, Inc., Logan, Utah

[21] Appl. No.: 297,075

[22] Filed: Jan. 13, 1989

[51] Int. Cl.[4] ..... H01H 35/00

[52] U.S. Cl. ..... 200/52 R; 200/61.58 R

[58] Field of Search ..... 200/52 R, 61.58 R, 43.01, 200/43.04–43.08, 43.16, 43.18, 43.19, 43.21, 46, 334

[56] References Cited

U.S. PATENT DOCUMENTS

| | | | |
|---|---|---|---|
| 3,227,818 | 1/1966 | Belaieff | 200/46 X |
| 4,370,545 | 1/1983 | Hotta et al. | 200/46 X |
| 4,771,148 | 9/1988 | Bersonnet | 200/61.58 R |

FOREIGN PATENT DOCUMENTS 1400538 7/1975 United Kingdom .

*Primary Examiner*—J. R. Scott

*Attorney, Agent, or Firm*—Trask, Britt & Rossa

[57] ABSTRACT

An exercise machine has an electrical safety switch which switch includes a base with a switch actuator attached thereto. A paddle is rotatably attached to the base for movement toward and away from the actuator. The paddle has an upper element and a lower element to form a void therebetween. The lower element as an aperture through which the actuator passes when the paddle is depressed. Placement of an enabling card in the void obstructs the aperture and enables operation of the actuator between "on" and "off" positions by depression of the paddle. Removal of the enabling card prevents accidental actuation of the machine.

11 Claims, 3 Drawing Sheets

EXERCISE MACHINE SAFETY SWITCH

BACKGROUND OF THE INVENTION

Field: This invention relates to switches for electrically powered machines and more particularly to safety switches for use with machines such as electrically operated exercise machines.

State of the Art: Various types of electrically powered machines including, specifically, exercise equipment such as treadmills, employ an "on" and "off" switch in order to cause the machine to be turned on or energized and subsequently turned off or de-energized. A wide variety of switches may be used, including push button switches, toggle switches and sliding switches. Typical switches as noted require a positive action on the part of the user to place the switch in the "on" position and another positive action to place it in the "off" position. Because of the physical arrangement of some of the switches, it may be accidentally moved from an "off" condition to an "on" condition. That is, someone could bump the switch or accidentally depress it to cause a machine to be energized. For some machines, accidental energization may be dangerous and may even cause an accident and injury.

U.S. Pat. No. 4,771,148 (Bersonnet) discloses an exercise machine switch in which the user must perform two actions to cause the switch to be placed in an "on" condition, and one action to cause the switch to be placed in an "off" condition. Therefore, accidental energization or activation by placing the switch in the "on" condition is minimized. Yet rapid de-energization may be effected because only one action is involved.

Switches such as those disclosed in U.S. Pat. No. 4,771,148 have not received widespread acceptance for use on exercise machines because the exercise machines involved appear to have evolved to machines having a control console containing various operating switches, dials and other information for the user. A suitable switch which cannot be accidentally activated without a positive action on the part of the user is desirable for use with powered machines and more particularly, powered exercise machines with a control console arrangement.

SUMMARY OF THE INVENTION

A safety switch has a base with a paddle positioned to move toward and away from the base. The paddle has a lower element spaced from an upper element a preselected height or distance to form a void. Switch means are secured to the base. The switch means has a housing and an actuator extending from the housing and the base a distance less than the preselected height between the upper and lower elements. The switch means is operable between the closed position and an open position upon operation of the actuator. An aperture is formed in the lower element of the console and is positioned to register with the actuator and sized to receive the actuator therethrough. An enabling card is removably positioned within the void to obstruct the aperture and reduce the preselected height to be less than the distance of the actuator extending from the housing of the switch. Upon movement of the paddle toward the base with the enabling card positioned within the void, the actuator is contacted by the enabling card and in turn operated between the open and the closed positions. With the enabling card removed, the switch is not operated as the actuator passes through the aperture and does not contact the upper element.

In a preferred embodiment, the switch includes spring means positioned to urge the paddle away from the base. Desirably, the base has two opposite ends, with the paddle rotatably secured to the base proximate one end. The base is an elongated flat surface and the lower member is preferably an elongated, flat surface. Desirably, the upper element is also an elongated flat member. It is even preferred that the console have a tongue extending away from the lower element with a lip formed along its outer or distal edge. The paddle preferably includes a spring means positioned on the tongue between the lip and the lower element to urge the enabling card away from the lower element.

In a more preferred embodiment, the enabling card is sized to be longer than the upper and lower elements and made of a material dimensioned to be substantially rigid upon application of a shear force thereto. Desirably, the first spring means is a spongy rubber-type material as is the second spring means. The switch actuator is preferably a spring return button and the switch is preferably one of the type in which the spring return button is sequentially pushed and released to cycle the switch between its open and closed positions.

In yet another embodiment, the exercise switch is preferably for use in a control console of an exercise machine.

BRIEF DESCRIPTION OF THE DRAWINGS

In the drawings which depict what is presently regarded as the preferred embodiment of the invention.

DESCRIPTION OF THE ILLUSTRATED EMBODIMENTS

Figure 1:
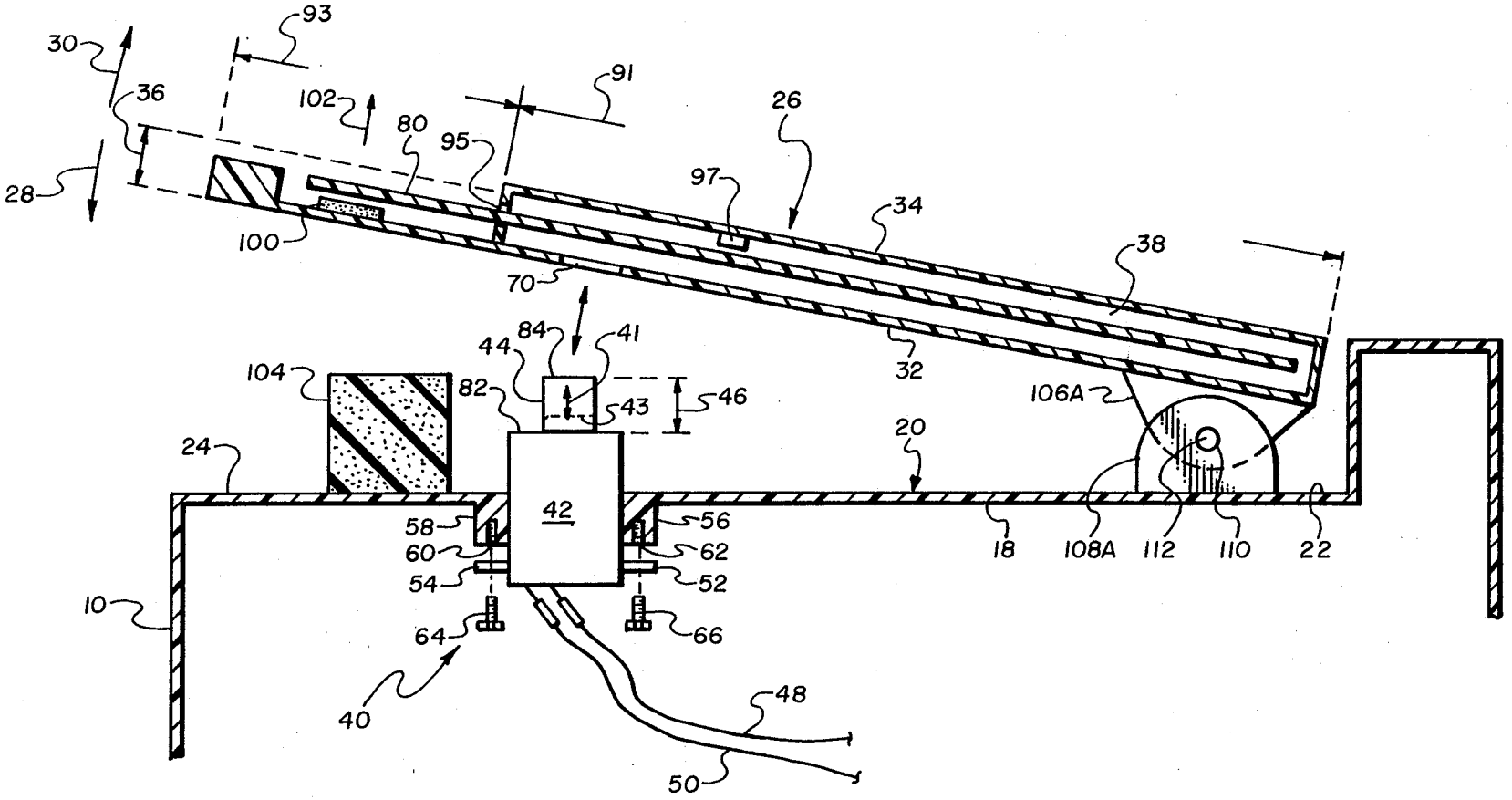
FIG. 1 is a cross section of a safety switch of the instant invention.
Figure 2:
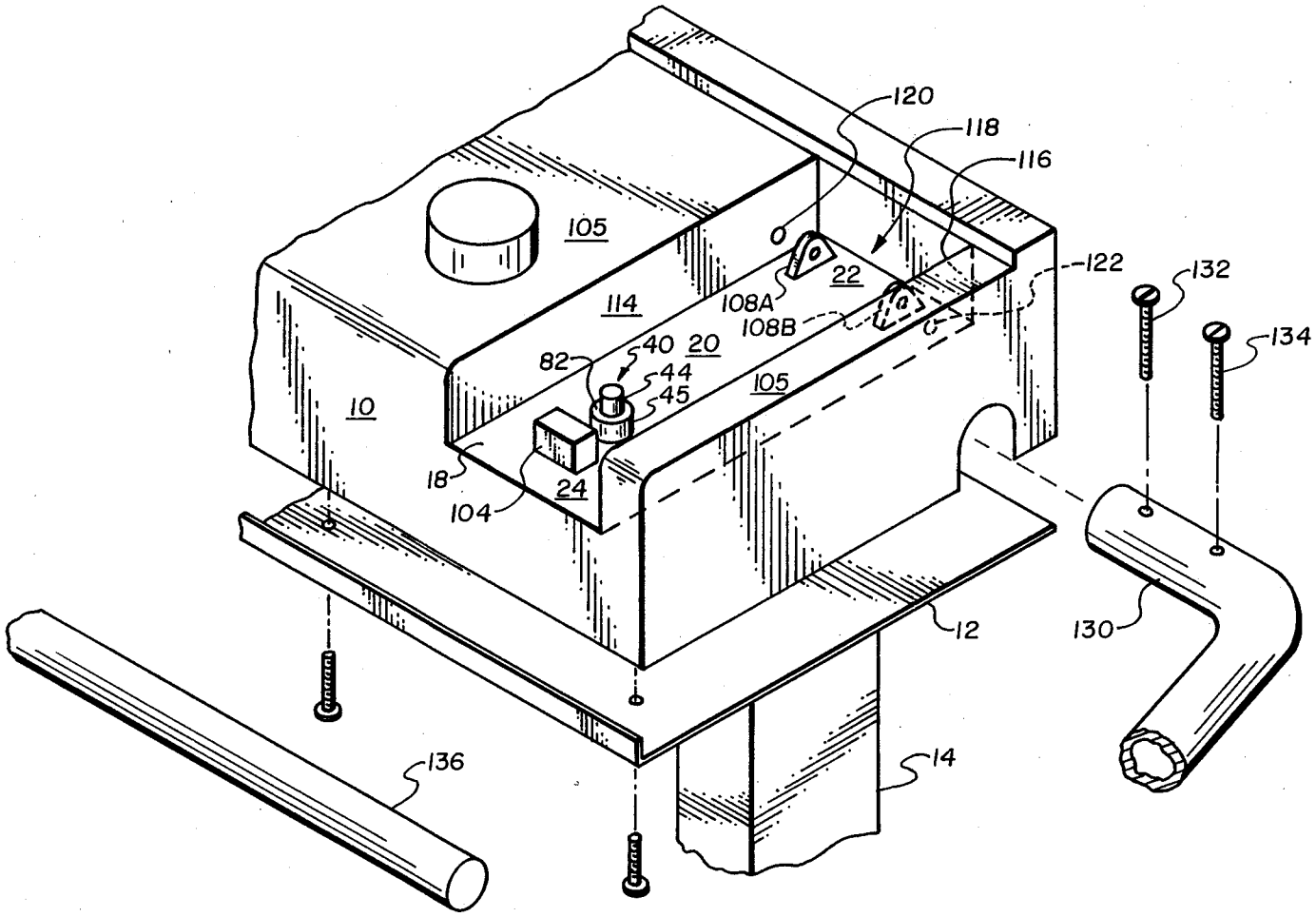
FIG. 2 is a partial perspective and blown apart view of control console portions of the switch of FIG. 1.

FIGS. 1 and 2 together show the safety switch of the instant invention in association with a control console 10 mounted to an exercise machine and more particularly to a support plate 12 adapted to an upright post 14 of a treadmill the remaining portions of which are not here illustrated for brevity, and the remaining portions of which are typical and known to those skilled in the art.

The switch of the instant invention has a base 18 which is here shown to have an elongated, flat surface 20 having a first end 22 and a second end 24. A paddle here generally depicted by the number 26 is positioned relative to the base 18 to move in direction 28 toward and in direction 30 away from the base 18. The paddle 26 shown in FIG. 1 has a lower element 32 spaced from an upper element 34 a preselected height or distance 36 to form a void 38.

Switch means generally depicted by the number 40 is secured to the base 18. As here shown, the switch means has a housing 42 and an actuator 44 extending from said housing a distance 46 which is selected to be less than the preselected height or distance 36 between the lower element 32 and the upper element 34. The switch means 40 is operable between a closed position and an open position upon up and down movement in directions 41 of the actuator 44.

The switch means 40 illustrated in FIG. 1 is a state of the art spring-actuated push button switch in which the button is depressed to operate the switch from one position to another and then operated or pushed a second time to cause the switch to operate and change position again. For example, the actuator 44 may be depressed to the position 43 shown in phantom to cause the switch 40 to be placed in the closed or "on" condition. Of course, the actuator 44 is spring-returned to a condition such as the condition shown in solid in FIG. 1. The actuator 44 is pressed a second time to position 43 causing the switch 40 to return from the closed or "on" position to an open or "off" condition. When in the "on" condition, the switch means 40 creates continuity between a first conductor 48 and a second conductor 50 wired to the switch housing 42. That is, it makes an electrical connection.

The switch means 40 shown in FIG. 1 is not shown in cross section because it is a typical push button switch of the type readily available in the art. The switch means 40 shown has flanges 52 and 54 which are positioned opposite tabs 56 and 58 which have holes 60 and 62 formed therein so that the switch means 40 may be secured by the use of screws or bolts 64 and 66 as shown.

Figure 3:
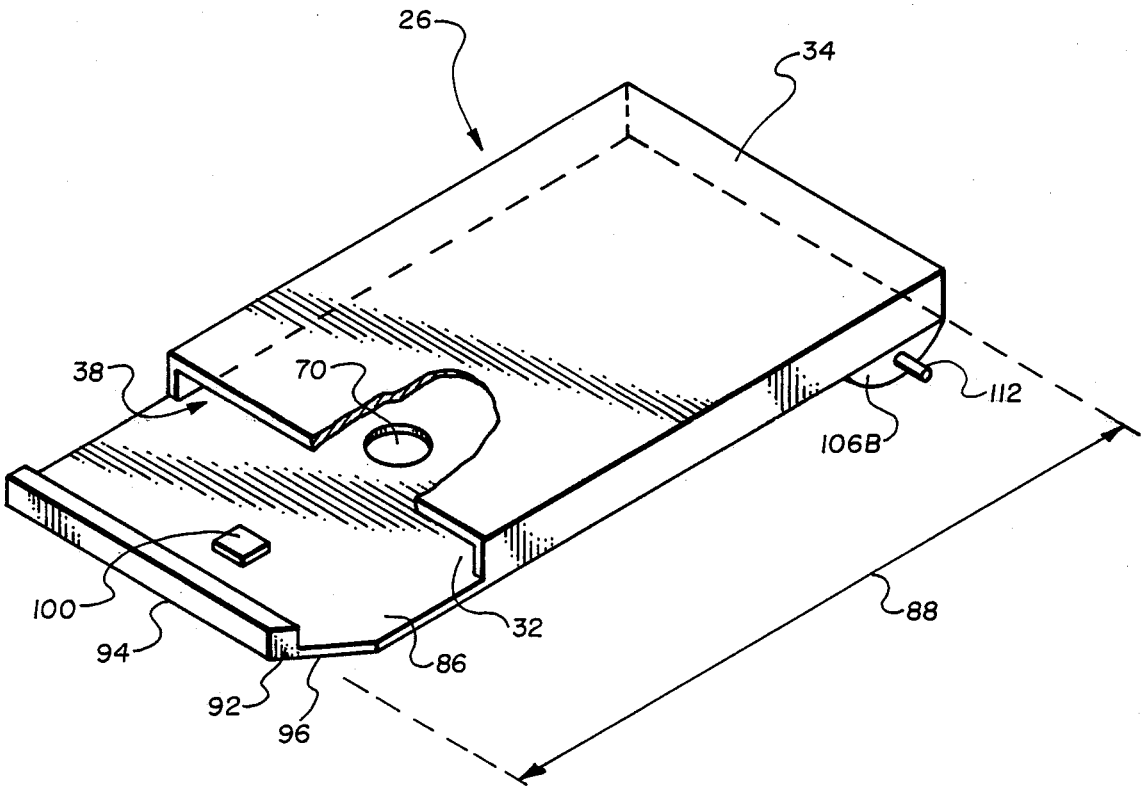
FIG. 3 is a perspective view of a paddle for use with the invention of FIG. 1.

As best seen in FIGS. 1 and 3, an aperture 70 is formed in the lower element 32 and positioned to register with the actuator 44 of the switch means 40. The aperture 70 is sized in cross section to receive the actuator 44 and allow it to pass therethrough as the paddle 26 is moved in direction 28 toward the base 18.

Figure 4:
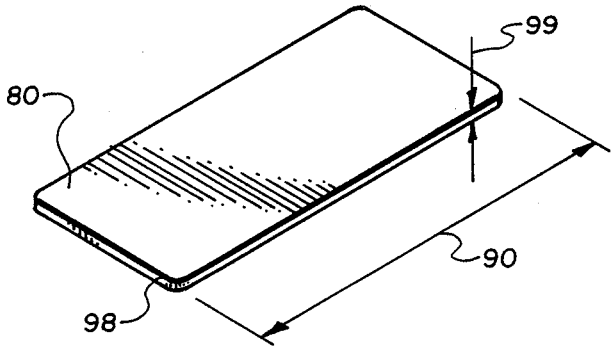
FIG. 4 is a perspective view of an enabling card for use with the invention of FIG. 1.

An enabling card 80 shown in perspective in FIG. 4 and in cross section in FIG. 1 is positionable within the void 38 to obstruct the aperture 70. When the card 80 is positioned in the void 38, the preselected height 36 is effectively reduced to be less than the distance 46 for the height of the actuator 44. As a result, when the paddle 26 is urged in direction 28 toward the base 18, the actuator 44 comes in contact with the enabling card 80 and, in turn, the actuator 44 is physically depressed into the housing 42 to actuate the switch means 40 from one position to another. When the enabling card 80 is removed from the void 38 and the paddle 26 is moved in direction 28 toward the base 18, the actuator 44 passes through the aperture 70. However, the lower element 32 strikes the shoulder 82 of the switch housing 42 before the upper surface 84 of the actuator 44 contacts the upper element 34. That is, the height 36 is larger than the height 46 so that the actuator 44 passes into the void 38 without being actuated. As a result, the switch 40 of the instant invention cannot be operated without the presence of an enabling card 80.

The enabling card 80 shown in FIG. 4, as well as in FIG. 1, is shown to be a thin elongate card comparable in thickness, material and dimension to a conventional credit card. The material of the card is selected to have sufficient structural strength to withstand the shear forces being applied upon moving the paddle 26 in direction 28 the base 18 and in turn urging the actuator 44 into the housing 42 to actuate the switch means 40. The height 36 of the void 38 is selected to receive the card 80. The height 46 is selected so that the actuator 44 will pass into the void 38 as stated before, but will be fully actuated with the card 80 inserted into the void 38.

To facilitate use of the card 80, the paddle 26 has a tongue 86 extending away from the lower element 32 so that the total distance 88, comprised of distances 91 and 93 of the lower element 32 and the tongue 86 respectively is slightly larger than the length 90 of the card 80 (e.g., $\frac{1}{8}''$ to $\frac{1}{4}''$) so that the card 80 may be easily inserted and placed into the void 38 generally as shown in FIG. 1. A lip 92 is formed on the distal end 94 of the tongue 86 to act as a barrier to prevent the card 80 from sliding out or being knocked out of the void 38. The card 80 may be shorter than the distance 88, the sum of distances 91 and 93 but not so short as to be less than distance 91 plus some additional length to facilitate grasping by the user.

Removal and insertion of the card 80 into the void 38 is facilitated because the tongue has an angulated edge 96 so that a corner of the card such as corner 98 may be grasped readily by the user to facilitate removal. To further enhance placement and removal of the card, a spring 100 is positioned near the lip 92 so that card will be urged outwardly in direction 102 or away from the lower element 32. As a result the user's fingers may be more readily manipulated to grasp the card and to facilitate its removal from the void 38.

The paddle 26 may have an edge 95 and even a longitudinal or transverse rib 97 to assist in regulating the distance the actuator 44 travels upon contact with the surface 84. Of course, if the card 80 has sufficient thickness 99, such are not required.

As can be seen in FIG. 1, the instant invention also includes spring means which is here shown to be a sponge rubber block 104 positioned proximate the switch means 40. Any spring means may be suitable for use, its function being simply to urge the paddle 26 away in direction 30 from the base 18.

The selection of a sponge rubber or neoprene foam spring 104 is preferred because of its relatively low cost and because it sufficient force to urge the paddle 26 outwardly in direction 30 without being an excessive force. That is, the outwardly force is relatively modest and at the same time does not cause the need for any mechanism to secure a conventional spring or wear surfaces for contact with such a spring to the base 18.

It may also be noted in FIG. 1 that the paddle 26 is mounted to rotate at one end 22 of the base 18. As here shown, an axle trunnion 106, shown here as left axle trunnion 106A, is formed with or attached to the lower surface 32 to extend away therefrom. Similarly, an axle trunnion 108, shown here as left axle trunnion 108A, is formed with or attached to the base 18 to extend upwardly and away therefrom. Both the lower surface trunnion 106 and the base trunnion 108 are formed to have apertures 110 with an axle 112 passing therethrough. Desirably, the axle 112 is sized in length to extend into the sidewalls 114 and 116 of a cavity 118 formed into the control console 10 of the exercise machine shown in FIG. 2. Additional support for the axle 112 is provided by the apertures 120 and 122 formed in the sidewall structure of the recess 118 to facilitate insertion of the axle 112 and in turn, to secure the paddle 26 as shown in FIG. 1.

Referring to FIGS. 2 and 3, the switch 40 of FIG. 1 is sized and configured for use with the control console 10. That is, the paddle 26 has a flat lower element 32 and a substantially flat upper element 34 which may be deemed to be substantially in alignment with the surface 20 of the base 18 with the paddle 26 depressed with the lower element 32 contacting the shoulder 82 of the switch housing 42. The paddle 26 is sized to fit snugly but yet movably within the recess 118. Alternatively, the trunnions 106 and 108, shown as left trunnions 106A and 108B respectively and right trunnions 106B and 108B respectively, are sized so that a flat upper element 34 will be essentially aligned with and in turn present a uniformly flat surface in combination with the top surface 105 of the control console 10. That is, after actuation, the spring 104 returns the paddle 26 and upper element 34 into alignment with surface 105.

As can be seen in FIG. 2, the control console 10 is mounted to a base 12 which is in turn mounted to the post 14. Also, the handle structure 130 is shown in an exploded arrangement for further assembly to the base 12 by bolts 132 and 134. The handle 130 is positioned to extend about the control console 10 to have a front section 136 for grasping by the user. Thus, the user may quickly move his hands from the handle 136 to activate the paddle 26 positioned within the recess 118 to both activate and deactivate the machine with the enabling card 80 positioned in the paddle 26.

It should be readily understood that the enabling card 80 may be removed to prevent accidental starting of the machine. Removal is intended to reduce the risk of potential accident and injury from inadvertent operation of the start-stop switch for the machine.

Reference herein to details of the illustrated embodiment is not intended to restrict the scope of the appended claims which themselves recite those features regarded as essential to the invention.

We claim:

1. A safety switch comprising:

a base with first and second opposing ends;

a paddle with first and second opposing ends, said paddle comprising a partitioned member having a lower element connectedly spaced from an upper element a preselected height to form a void;

securing means for rotatably securing said first end of said paddle to proximate said first end of said base, said second end of said paddle positioned to rotatably move toward and away from said second end of said base;

switch means secured to said base, said switch means having a housing and an actuator extending from said housing and said base a distance less than said preselected height, said switch means being operable between a closed position and an open position upon operation of said actuator;

an aperture formed in said lower element positioned to register with said actuator and sized to receive said actuator therethrough into said void; and an enabling card removably positionable in said void to obstruct said aperture and reduce said preselected height to be less than said distance so that upon movement of said paddle toward said base, said switch is not operated with said enabling card removed and said switch is operated between said open and closed positions with said enabling card positioned in said void.

2. The safety switch of claim 1 further including first spring means to urge said paddle away from said base.

3. The safety switch of claim 2 wherein said securing means comprises opposing axle trunnions on said first end of said paddle and said proximate first end of said base, said axle trunnions rotatably connected by an axle.

4. The safety switch of claim 2 wherein said base has an elongated flat surface and wherein said lower element is an elongated flat member.

5. The safety switch of claim 4 wherein said upper element is an elongated flat member, said paddle further comprising a tongue connected to and extending away from said partitioned member with a lip formed thereon.

6. The safety switch of claim 5 wherein said enabling card is sized to be longer than said upper and lower elements and of a material dimensioned to be substantially rigid upon application of a shear force.

7. The safety switch of claim 6 wherein said first spring means is a spongy rubber-type material.

8. The safety switch of claim 7 wherein said paddle includes second spring means positioned on said tongue between said lip and said lower element to urge said enabling card away from said lower element.

9. The safety switch of claim 8 wherein said switch actuator is a spring return button and wherein said switch is of the type in which the spring return button is pushed to cycle the switch between its open and closed positions.

10. A safety switch for use in an exercise machine having a control console, said safety switch comprising:

a rectilinear base with two opposed ends, said base being formed in the control console of an exercise machine;

a paddle having two opposed ends, said paddle being rotatably secured at one end thereof to said base at one end thereof to rotate at the opposite end thereof toward and away from the opposite end of said base, said paddle comprising a partitioned member having a lower element and an upper element spaced apart a preselected height to form a void, said paddle being sized and rotatably secured to substantially register with said base;

switch means secured to said base, said switch means having a housing and an actuator extending from said housing toward said paddle a distance less than said preselected height, said switch means being operable between a closed position and an open position upon operation of said actuator;

an aperture formed in said lower element positioned to register with said actuator and sized to receive said actuator therethrough up to said preselected height without operating said actuator; and an enabling card removably positionable in said void to obstruct said aperture and reduce said preselected height to be less than said distance so that upon movement of said paddle toward said base, said switch is not operated with said enabling card removed and said switch is operated between said open and closed positions with said enabling card positioned in said void.

11. A safety switch comprising:

a base;

a paddle positioned to move toward and away from said base, said paddle including a lower element connected to and spaced from an upper element a preselected height to form a void;

securing means for securing said paddle to said base to move toward and away from said base;

switch means secured to said base, said switch means having a housing and an actuator extending from said housing and said base a distance less than said preselected height, said switch means being operable between a closed position and an open position upon operation of said actuator;

an aperture formed in said lower element positioned to register with said actuator and sized to receive said actuator therethrough into said void without operating said actuator; and an enabling card removably positionable in said void to obstruct said aperture and reduce said preselected height to be less than said distance so that upon movement of said paddle toward said base, said switch is not operated with said enabling card removed and said switch is operated between said open and closed positions with said enabling card positioned in said void.

* * * * *

UNITED STATES PATENT OFFICE

CERTIFICATE OF CORRECTION

Patent No. 4,918,266 Dated April 17, 1990

Inventor(s) William T. Dalebout; Ty Measom

It is certified that error appears in the above-identified patent and that said Letters Patent is hereby corrected as shown below:

Col. 3, line 61 after 28 insert "toward"

Col. 4, line 36 before sufficient insert "provides"

Signed and Sealed this

Fifth Day of November, 1991

*Attest:*

HARRY F. MANBECK, JR.

*Attesting Officer*

*Commissioner of Patents and Trademarks*